US005433157A

United States Patent [19]

Dittmann et al.

[11] Patent Number: 5,433,157

[45] Date of Patent: Jul. 18, 1995

[54] GRATE PLATE FOR THRUST GRATING COOLERS FOR COOLING HOT MATERIAL

[75] Inventors: Guenter Dittmann, Dessau; Claus Bauer, Cologne; Ralf Filges, Bergisch Gladbach, all of Germany

[73] Assignee: Kloeckner-Humboldt-Deutz AG, Cologne, Germany

[21] Appl. No.: 118,216

[22] Filed: Sep. 9, 1993

[51] Int. Cl.[6] ..... F23H 7/08; F23K 3/12; F27D 15/02

[52] U.S. Cl. ..... 110/289; 110/281; 110/291; 110/299; 432/78

[58] Field of Search ..... 432/77-80; 110/289-291, 299

[56] References Cited

U.S. PATENT DOCUMENTS

| | | | |
|---|---|---|---|
| 4,563,959 | 1/1986 | Fujiwara | 110/291 |
| 4,767,462 | 8/1988 | Pons de Vinals | 106/101 |
| 4,870,913 | 10/1989 | Schneider | 110/299 |
| 5,174,747 | 12/1992 | Massaro, Jr. et al. | 432/78 |
| 5,197,397 | 3/1993 | Yamagishi et al. | 110/281 |
| 5,271,339 | 12/1993 | Yamagishi et al. | 110/291 |
| 5,282,741 | 2/1994 | Massaro et al. | 432/78 |

FOREIGN PATENT DOCUMENTS

| | | |
|---|---|---|
| 3734043 | 4/1989 | Germany . |
| 3812425 | 10/1989 | Germany . |
| 770324 | 4/1989 | U.S.S.R. . |

*Primary Examiner*—Henry C. Yuen
*Assistant Examiner*—Erick Solis
*Attorney, Agent, or Firm*—Hill, Steadman & Simpson

[57] ABSTRACT

In order to create a grate plate design for a thrust grating cooler for cooling hot material such as, for example, cement clinker, this grate plate design has troughs at its upper side for accepting and retaining cool material for the purpose of protecting the grate plate against thermal overload, whereby these troughs are to be supplied with cooling air via cooling air channels arranged therebetween and via air exit slots without the risk of blockage thereof. A grate plate is provided wherein a plurality of cooling air channels that extend up to the upper side of the grate plates and limit the troughs from one another are arranged in the grate plate member parallel to the longitudinal axis of the grate plates, and whereby the partitions between the air channels and the troughs comprise air exit slots proceeding parallel to the longitudinal axis of the plates which are arranged immediately above the bottom plate of the grate plate.

20 Claims, 2 Drawing Sheets

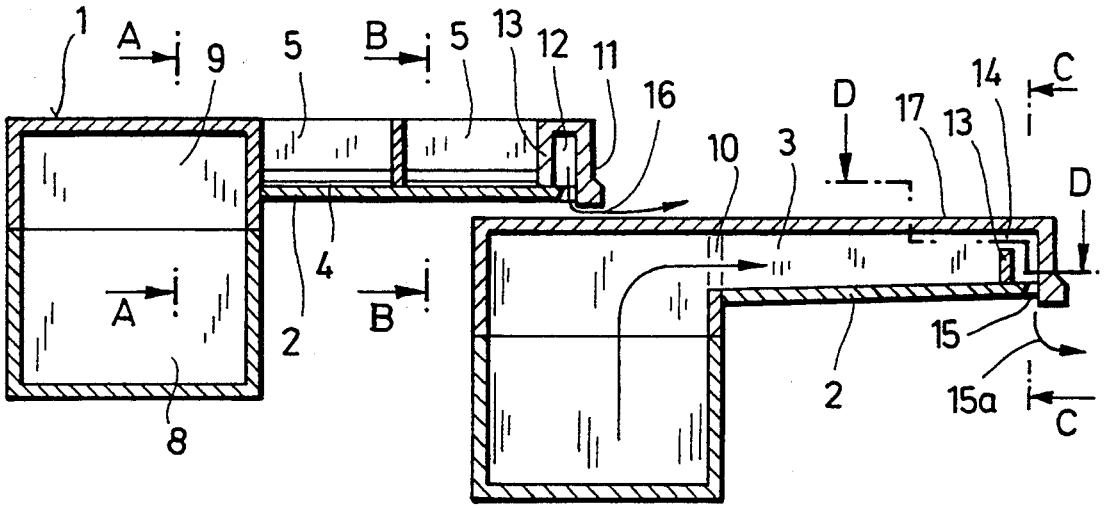
FIG.1
FIG.2
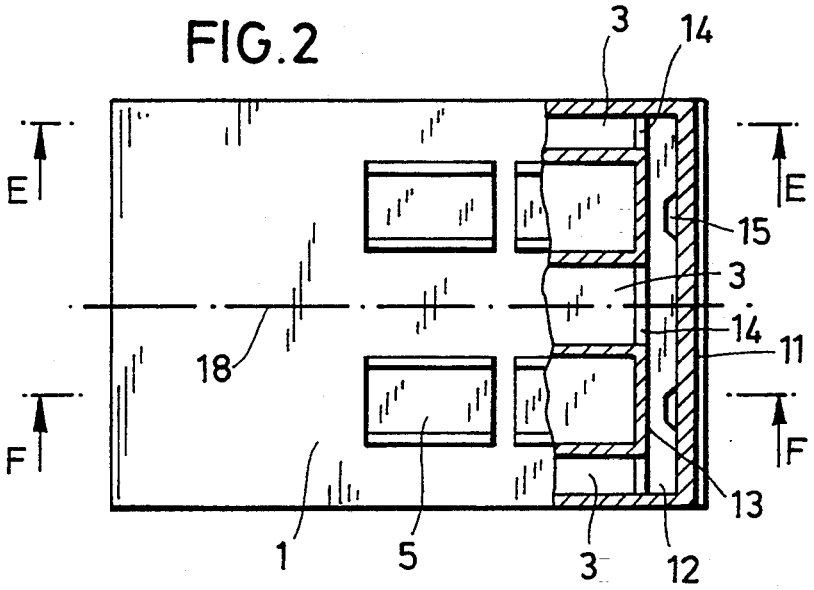

GRATE PLATE FOR THRUST GRATING COOLERS FOR COOLING HOT MATERIAL

BACKGROUND OF THE INVENTION

The invention is directed to a grate plate for thrust grating coolers for cooling hot material, comprising outwardly open troughs arranged at the upper side of the grate plate, whereby a plurality of grate plates having cooling air flowing through them are secured to grate plate carriers that are alternately stationary and reciprocally movable in a grate conveying direction.

In a thrust grating cooler, the grate system is composed of a plurality of stationary and movable grate plate carriers on which are arranged a plurality of grate plates that are provided with openings for cooling air and are essentially flowed-through by cooling air from bottom to top. As viewed in the conveying direction, the stationary grate plate rows alternate with reciprocally movable grate plate rows. The movable rows are secured in common to one or more driven thrust frames seated longitudinally movable, being secured thereto via their correspondingly reciprocally movable grate plate carriers. As a result of the common, oscillating movement of all movable grate plate rows, the material to be cooled, for example the hot cement clinker emerging from a rotary tubular kiln, is conveyed thrustwise and thereby cooled.

A cooler grate plate is known (German Published Application 38 12 425) whose upper side comprises troughs that serve the purpose of accepting and retaining cool material, this material shielding the grate plate from the hot material situated therabove. Such an arrnagement preserves the grate plate and lengthens its useful life. In the known grate plate provided with troughs, U-shaped trough webs are welded into the grate plate members, whereby the inside of the upwardly open troughs is supplied with cooling air from the side through air exit slots that are arranged well above the bottom plate of the grate plates. The cool material received inside the troughs, however, is not prevented from dropping through the lateral air exit slots toward the outside onto the bottom plate of the known grate plate design. This dropped cool material lead to blockages of the air conduits and, thus, to a reduction of the throughput of cooling air through the grate system.

The lateral air exit slots into the troughs of the known grate plate are produced by partial coverings of the upwardly open U-profiles as a result whereof a jamming of the cool material in the troughs can occur. Cool material jammed in the troughs can then impede the oscillating motion of the movable grate plate rows. In the known trough grate plate, moreover, the front plate face, as seen in thrust direction of the grate, and which is especially stressed, is not adequately cooled, as a result whereof the risk of thermal overloading of the grate plate in this region is established.

SUMMARY OF THE INVENTION

An object of the invention is to avoid the above described disadvantages and to create a grate plate provided with troughs or pockets for a thrust grating cooler that has a long functionability due to its grate plate design.

In the grate plate of the invention for a thrust grating cooler, a plurality of cooling air channels that extend up to the upper side of the grate plates and limit the grate plate troughs from one another are arranged in the grate plate member parallel to the longitudinal axis of the grate plates. These cooling air channels extend, like the hollow member profiles, over the entire length of the grate plate up to what is the front plate face as viewed in the grate thrust direction. These cooling air channels supply the grate plate troughs lying therebetween, that serve the purpose of accepting and retaining cool material, with cooling air from below, namely via air exit slots that proceed parallel to the longitudinal axis of the plates. These air exit slots are inventively arranged immediately above the bottom plate of the grate plate in the partitions that separate the air channels from the grate plate troughs, so that passages of cool material from the grate plate troughs into the neighboring air channels can only lead to a slight accumulation of cool material on the bottom plate of the grate plate of the invention but cannot lead to a blockage of the air channels.

The side walls of the grate plate troughs are essentially fashioned vertically and smooth, as a result whereof a jamming of the cool material retained by the troughs which could impede the oscillating motion of the movable grate plates rows cannot occur. The air channels are arranged parallel to the longitudinal axis of the plates, extend up to what is the front plate face as viewed in grate thrust direction, and discharge thereat into a front cooling channel that lies transversely relative to the longitudinal axis of the plate and which is constantly traversed by cooling air. Thus, this front face of the grate plate is always adequately cooled. The cooling air flowing out in this region into the overlap gap between the moving grate plate rows and the immobile grate plate rows simultaneously serves as blocking air at this location which prevents a clogging of the overlap gap and a penetraton of clinker dust into the front coolng channel of the grate plate of the invention.

BRIEF DESCRIPTION OF THE DRAWINGS

The invention and further features and advantages thereof shall be set forth in greater detail with reference to the exemplary embodiments schematically shown in the figures.

FIG. 1 illustrates in the left-hand region, a vertical longitudinal section through a grate plate of the invention along the line F—F of FIG. 2 and, in the right-hand region, a vertical longitudinal section through the grate plate of the invention along the line E—E of FIG. 2;

FIG. 2 illustrates portions of the section through the grate plate along the line D—D of FIG. 1;

DETAILED DESCRIPTION OF THE PREFERRED EMBODIMENTS

Figure 3:
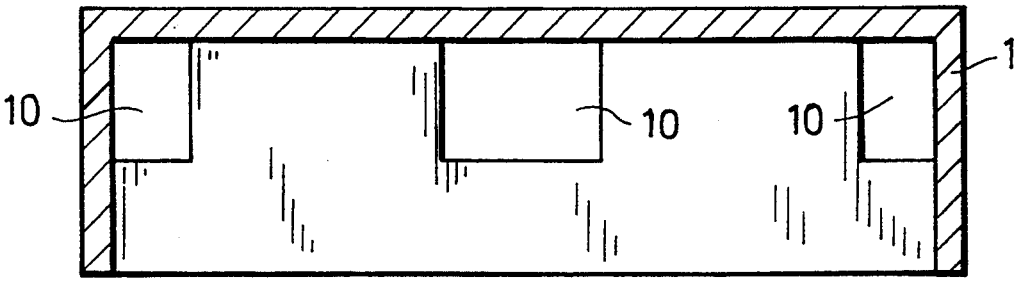
FIG. 3 illustrates the cross-section along the line A—A of FIG. 1.

According to FIG. 1, the grate plate of the invention for a thrust grating cooler comprises a grate plate member 1 that, for example, can be composed of a one-piece, metallic cast member which is secured to individual, aerated grate plate carriers 8. A bottom plate 2 is firmly joined, for example screwed or welded from below, to that part of the grate plate member 1 that protrudes from the grate plate carrier 8 toward the front, in a thrust direction, of the thrust grating cooler. In the exemplary embodiment, the upper side of the grate plate comprises four upwardly open troughs or pockets 5 that serve the purpose of up to an upper side 17 of the grate plates and limit the troughs 5 from one another are arranged in the grate plate member 1 above the bottom plate 2 and parallel to the longitudinal axis 18 of the grate plates.

Figure 4:
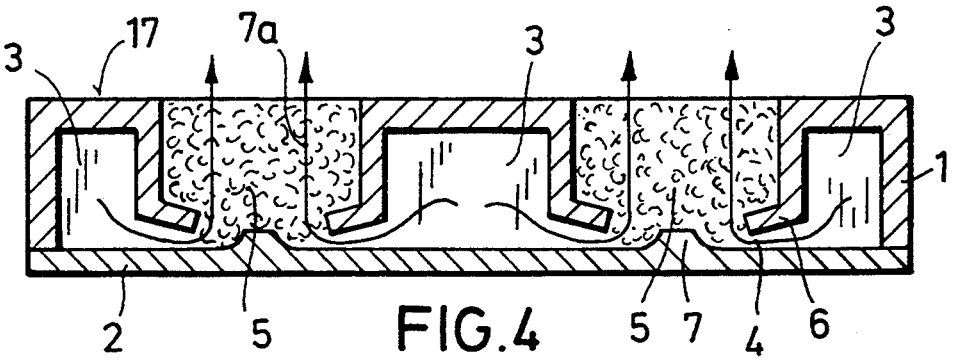
FIG. 4 illustrates the cross-section along the line B—B of FIG. 1.

As shown in FIG. 4, the partitions between the air channels 3 flooded by cooling air and the troughs 5 serving the purpose of accepting and retaining cool material comprise air exit slots 4 that proceed parallel to the longitudinal axis 18 of the plates, these air exit slots 4 being arranged immediately above the bottom plate 2 of the grate plate. That is, the air exit slots 4 are limited by the bottom plate 2 and by those parts 6 of the partitions between the air channels 3 and the troughs 5 that are kinked or bent off downwardly and inwardly in the direction toward the center of the troughs 5. As is also shown in FIG. 4, salient ledges 7 that rise up and proceed parallel to the air exit slots 4 or to the longitudinal axis 18 of the plates, are arranged on the bottom plate 2 in the middle of the troughs 5 and act as guide means for the cooling air which steer the cooling air flowing out of the air exit slots 4 horizontally in the troughs 5 upward into the direction *7a*.

Figure 5:
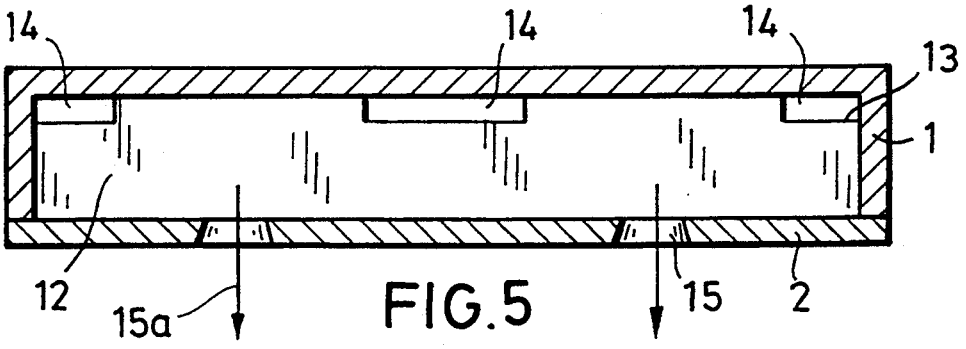
FIG. 5 illustrates the cross-section along the line C—C of FIG. 1.

It is illustrated in FIGS. 1 and 3 that the cooling air introduced into the individual, aerated grate plate carriers 8 proceeds into the air chamber 9 that is connected to the three air conduits 3 by three channel openings 10. A front cooling channel 12 is arranged between the troughs 5 and what is a front plate face 11 as viewed in the grate thrust direction. This cooling channel 12 lies transversely relative to the longitudinal axis 18 of the plates and receives the quantity of cooling air required for cooling the front plate face 11 from the air channels 3 through three delivery openings 14 present in a front partition 13. This quantity of cooling air branched off from the total cooling air flowing through the grate plate of the invention leaves the front cooling channel 12 through smaller discharge openings 15 in the bottom plate 2. The quantity of cooling air referenced 15*a* amounts to approximately 5 to 10% of the total air put through the grate plate of the invention and it simultaneously serves as blocking air in the overlap slot 16 between the individual grate plate rows of the thrust grating cooler. As shown in FIG. 5, the three delivery openings 14 for cooling air in the partition 13 that limit the air channels 3 and troughs 5 from the front cooling channel 12 are located in the upper region of the air channels 3. That is, the delivery openings 14 are flush with the upper inside surface of the air channels 3 and the dimensions correspond to their width and to approximately 30% of the height of the air channels 3. It also proceeds from FIGS. 3 and 4 that the three channel openings 10 present in the front side wall of the air chamber 9 correspond in cross-section to the three air channels 3.

In the grate plate of the invention, the air channels 3 cannot occlude since cool material can only pass from the troughs 5 into the air channels 3 to a slight degree through the air exit slots 4 as a consequence of the force of gravity on the cool material. Since the troughs 5, moreover, are surrounded by smooth, vertical side walls, a jamming of the cool material lying in the troughs 5 cannot occur. The front end face 11 of the grate plate is adequately cooled by the quantity 15*a* of cooling air that flows through the front cooling channel 12 and, since the delivery openings 14 for the cooling air are arranged in the upper region of the air channels 3, cool material that has proceeded into the air channels 3 is prevented from being washed into the front cooling channel 12. Finally, the bottom plate 2, firmly attached to the grate plate member, 1 makes a reliable sealing of the underside of the grate plate possible.

The invention cannot only be employed in grate plates for thrust grating coolers having individual, aerated grate plate carriers fashioned like hollow beams but can also be employed in grate plates for thrust grating coolers that comprise a chamber-aerated grate system. In this latter case, the bottom plate 2 must then comprise perforations for the purpose of allowing the cooling air to pass through.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

We claim as our invention:

1. A grate plate for thrust grating coolers for cooling hot material, the thrust grating cooler having a material inlet, a material outlet, and a plurality of rows of grate plates, with each preceding row of plates overlapping a portion of the following row of plates, said grate plate having upwardly open troughs for receiving the hot material arranged at an upper side of the grate plate, comprising: a plurality of cooling air channels, formed by inverted u-shaped partitions that have side walls which extend up to an upper side of the grate plates and limit the troughs from one another, are arranged in the grate plate member parallel to a longitudinal axis of the grate plate; and the walls of the partitions between the air channels and the troughs have air exit slots proceeding parallel to the longitudinal axis of the plates, the slots being positioned directly above a bottom plate of the grate plate to admit air into the troughs.

2. A grate plate according to claim 1, wherein the side walls of the partitions limiting the air channels from the troughs are bent off downward and inward in the direction toward the center of the troughs in the region of the air exit slots.

3. A grate plate according to claim 1, wherein the air channels arranged parallel to the longitudinal axis of the plates are connected via delivery openings through a partition to a front cooling channel that is arranged transversely relative to the longitudinal axis of the plate and following a front plate face, the bottom plate comprising exit openings for the discharge of cooling air in the region of said front cooling channel.

4. A grate plate according to claim 3, wherein the delivery openings terminate flush with the upper inside surface of the air channels; and the dimensions of the delivery openings correspond to the width of the air channels and approximately 30% of their height.

5. A grate plate according to claim 1, wherein guide devices for cooling air in the form of ledges that proceed in the middle of the troughs parallel to the air exit slots are arranged on the bottom plate that terminates the grate plate member from below.

6. A grate plate according to claim 1, wherein the bottom plate that terminates that part of the grate plate member from below which protrudes from the grate plate carrier is firmly joined to the plate member.

7. A thrust grating cooler for cooling hot material, the thrust grating cooler having a material inlet, a material outlet, and a plurality of rows of grate plates, with each preceding row of plates overlapping a portion of the following row of plates, comprising:

a plurality of grate plate carriers arranged in a conveying direction, with alternate ones of said carriers mounted in a stationary position and opposite alternate carriers mounted to be reciprocally movable in said conveying direction;

a plurality of grate plate members having a top wall and a bottom wall, one of said grate plate members being secured to each of said grate plate carriers;

a plurality of open troughs arranged at an upper side of each of said grate plate members;

a plurality of cooling air channels formed within each of said grate plate members in the form of inverted u-shape channels which extend vertically between said top wall and said bottom wall of said grate plate member and which have vertical side walls defining said troughs;

said vertical side walls having air exit slots along their length adjacent to said bottom plate of said grate plate member, said air exit slots providing a communication path between said cooling air channels and said troughs.

8. A thrust grating cooler according to claim 7, wherein said side walls between said cooling air channels and said troughs angle downwardly and inwardly in the direction toward the center of said troughs at said air exit slots.

9. A thrust grating cooler according to claim 7, wherein said cooling air channels communicate with a perpendicularly arranged cooling channel that follows a front plate of said grate plate extending between said top and bottom plates.

10. A thrust grating cooler according to claim 9, wherein said perpendicularly arranged cooling channel communicates with air exit openings in said bottom wall.

11. A thrust grating cooler according to claim 9, wherein said cooling air channels communicate with said perpendicularly arranged cooling channel through openings adjacent to said top wall.

12. A thrust grating cooler according to claim 11, wherein said openings have a width equal to a width of said air cooling channels and a height approximately 30% of a height of said air cooling channels.

13. A thrust grating cooler according to claim 7, wherein guide ledges are formed in a bottom wall of said troughs, parallel to said air exit slots.

14. A thrust grating cooler for cooling hot material, the thrust grating cooler having a material inlet, a material outlet, and a plurality of rows of grate plates, with each preceding row of plates overlapping a portion of the following row of plates, comprising:

a plurality of grate plate carriers arranged in a conveying direction, with alternate ones of said carriers mounted in a stationary position and opposite alternate carriers mounted to be reciprocally movable in said conveying direction;

a plurality of grate plate members having a top wall and a bottom wall, one of said grate plate members being secured to each of said grate plate carriers such that said bottom wall protrudes from a front of said grate plate carrier in said conveying direction;

a plurality of open troughs arranged at an upper side of each of said grate plate members, said troughs extending along a longitudinal axis parallel to said conveying direction;

a plurality of cooling air channels formed within each of said grate plate members in the form of inverted u-shape channels which extend vertically between said top wall and said bottom wall of said grate plate member and which have vertical side walls extending longitudinally, defining said troughs;

said vertical side walls having air exit slots along their length adjacent to said bottom plate of said grate plate member, said air exit slots providing a communication path between said cooling air channels and said troughs.

15. A thrust grating cooler according to claim 14, wherein said side walls between said cooling air channels and said troughs angles downwardly and inwardly in the direction toward the center of said troughs at said air exit slots.

16. A thrust grating cooler according to claim 14, wherein said cooling air channels communicate with a perpendicularly arranged cooling channel that follows a front plate of said grate plate extending between said top and bottom plates.

17. A thrust grating cooler according to claim 16, wherein said perpendicularly arranged cooling channel communicates with air exit openings in said bottom wall.

18. A thrust grating cooler according to claim 16, wherein said cooling air channels communicate with said perpendicularly arranged cooling channel through openings adjacent to said top wall.

19. A thrust grating cooler according to claim 18, wherein said openings have a width equal to a width of said air cooling channels and a height approximately 30% of a height of said air cooling channels.

20. A thrust grating cooler according to claim 14, wherein guide ledges are formed in a bottom wall of said troughs, parallel to said air exit slots.

* * * * *